US006260390B1

(12) United States Patent
Carr

(10) Patent No.: US 6,260,390 B1
(45) Date of Patent: Jul. 17, 2001

(54) DRY CLEANING PROCESS USING ROTATING BASKET AGITATION

(75) Inventor: Robert B. Carr, Brookline, MA (US)

(73) Assignee: Sail Star Limited, Causeway Bay (HK)

( * ) Notice: Subject to any disclaimer, the term of this patent is extended or adjusted under 35 U.S.C. 154(b) by 0 days.

(21) Appl. No.: 09/266,146

(22) Filed: Mar. 10, 1999

(51) Int. Cl.[7] ..... D06F 43/08
(52) U.S. Cl. ..... 68/18 R
(58) Field of Search ..... 8/158, 142; 68/18 R, 68/18 C; 134/10, 12, 107

(56) References Cited

U.S. PATENT DOCUMENTS

| | | | |
|---|---|---|---|
| 400,441 | 4/1889 | Cooper . | |
| 2,161,208 | 6/1939 | Soderholm | 8/159 |
| 2,219,490 | 10/1940 | Pisarev | 8/111 |
| 3,969,196 | 7/1976 | Zosel | 203/49 |
| 4,012,194 | 3/1977 | Maffei | 8/142 |
| 5,013,366 | 5/1991 | Jackson et al. | 134/1 |
| 5,123,176 | 6/1992 | Yamada et al. | 34/32 |
| 5,267,455 | 12/1993 | Dewees et al. | 68/5 |
| 5,279,615 | 1/1994 | Mitchell et al. | 8/142 |
| 5,316,591 | 5/1994 | Chao et al. | 134/34 |
| 5,339,844 | 8/1994 | Stanford, Jr. et al. | 134/107 |
| 5,412,958 | 5/1995 | Iliff et al. | 68/5 |
| 5,456,759 | 10/1995 | Stanford, Jr. et al. | 134/1 |
| 5,467,492 | 11/1995 | Chao et al. | 8/159 |
| 5,669,251 | 9/1997 | Townsend et al. | 68/58 |
| 5,759,209 | 6/1998 | Adler et al. | 8/142 |
| 5,858,022 | 1/1999 | Romack et al. | 8/142 |
| 5,904,737 | 5/1999 | Preston et al. | 8/158 |
| 6,050,112 * | 4/2000 | Walker | 68/18 C X |
| 6,073,292 * | 6/2000 | Lindqvist et al. | 68/18 C X |
| B1 4,219,333 | 2/1984 | Harris | 8/137 |

FOREIGN PATENT DOCUMENTS

| | | |
|---|---|---|
| 2027003 | 12/1971 | (DE) . |
| 3904513 A1 | 8/1990 | (DE) . |
| 4004111 A1 | 8/1990 | (DE) . |
| 3906724 C2 | 3/1998 | (DE) . |
| 3904514 C2 | 3/1999 | (DE) . |
| 3906735 C2 | 4/1999 | (DE) . |
| 0518653 B1 | 9/1995 | (EP) . |
| 0530949 B1 | 9/1995 | (EP) . |
| WO 90/06189 | 6/1990 | (WO) . |

* cited by examiner

*Primary Examiner*—Philip R. Coe
(74) *Attorney, Agent, or Firm*—Weingarten, Schurgin, Gagnebin & Hayes LLP

(57) ABSTRACT

A dry cleaning process and system for cleaning articles disposed in a cleaning chamber having a rotatable member therein, using carbon dioxide ($CO_2$) from a storage tank. The process includes causing a pressure differential between the storage tank and the cleaning chamber, filling the cleaning chamber with a predetermined amount of liquid $CO_2$ enabling flow of liquid $CO_2$ from the storage tank to the cleaning chamber in response to the pressure differential, and rotating the rotatable member.

8 Claims, 8 Drawing Sheets

DRY CLEANING PROCESS USING ROTATING BASKET AGITATION

FIELD OF THE INVENTION

The present invention relates to dry cleaning processes in general and, more particularly, to a dry cleaning process and system utilizing a solvent and having a rotatable container for agitating articles.

BACKGROUND OF THE INVENTION

Existing dry cleaning processes function by mechanically agitating articles to be cleaned, e.g., clothes, and a solvent. Typically, articles of clothing are placed in a container or basket with an amount of a chemical solvent that loosens dirt and dissolves staining matter from the clothes. The clothes are then agitated by movement of the basket to increase the effectiveness of the cleaning process. The agitation is often in the form of rotation, and rotation with an axis in the horizontal plane makes use of gravitational forces to further increase the amount of agitation.

Many chemical solvents are environmentally hazardous and present public health and safety risks. As a result, a number of solvents have been banned by law or heavily regulated. In addition, "environmentally friendly" alternatives have been sought. One such alternative is using liquid carbon dioxide ($CO_2$) as a solvent.

Dry cleaning systems and processes using liquid/supercritical dense-phase gas such as carbon dioxide ($CO_2$) are known in the art. In such processes, liquid $CO_2$ is pumped throughout the system using a heavy-duty positive displacement pump. Specifically, liquid $CO_2$ is pumped from a reservoir into a cleaning chamber where articles come into contact with the $CO_2$. The articles are cleaned by agitation, such as by rotation of a container holding the articles, and finally, the liquid $CO_2$ is pumped back into the reservoir. The pump is also used during additional steps of the dry cleaning process as are known in the art.

The use of such a pump has a number of disadvantages that render prior art systems complex and/or cost-inefficient for many applications. One disadvantage is that the pump is a relatively expensive element of the dry cleaning system. Another disadvantage is that the pump requires a net positive suction head ("NPSH"). This head is generated by both the fluid level in whatever vessel is to be drained and the elevation of the vessel relative to the pump inlet. Configurations that provide adequate pressure such as tall vessels or mounting the vessel about the pump are not desirable because they result in a large machine. Furthermore, completely draining the cleaning chamber still may be difficult because NPSH decreases as the chamber empties.

Another method of providing adequate pump head is by using a distillation chamber. Gas is heated in the chamber, and the resultant pressure increase is used to provide the desired NPSH. However, the use of such a distillation chamber adds complexity and cost to the system.

Furthermore, the pump is susceptible to damage and wear from dirt suspended in the fluid, which reduces the pumping efficiency. Filters cannot be used on the suction side of the pump because they decrease the pressure at the pump inlet, adding to the problem of attaining adequate positive pressure head. Thus, in addition to equipment and operating costs, frequent maintenance is also necessary.

SUMMARY OF THE INVENTION

It is an object of the present invention to provide a process and a system for efficiently supplying and/or recycling liquid carbon dioxide ($CO_2$) in a dry cleaning system using a rotating basket. In accordance with the process of the present invention, pressurized liquid $CO_2$ is transported between a storage tank and cleaning chamber by means of a pressure differential produced between the tank and chamber, obviating the need for a pump. This eliminates the disadvantages typically associated with such pumps, such as high equipment cost, maintenance downtime and costs due to wear and low efficiency and, thus, expands the circumstances in which the present invention may be used.

In an embodiment of the present invention, the pressure differential is produced by a gas compressor which does not directly interact with liquid $CO_2$ and, thus, does not accumulate dirt suspended in the liquid $CO_2$. This eliminates the problems associated with pumps used by prior arty systems, making the system of the present invention more cost effective and reliable. The compressor draws gaseous $CO_2$ from the cleaning chamber and injects it into the storage tank, or vice versa, to create either a positive or a negative pressure differential, respectively, between the storage tank and the cleaning chamber. A positive pressure differential enables flow of liquid $CO_2$ from the storage tank to the cleaning chamber. A negative pressure differential enables flow of liquid $CO_2$ from the cleaning chamber to the storage tank. The magnitude of the pressure differential may be controlled by varying the speed of the compressor motor or using a throttle valve.

The dry cleaning process of the present invention may also include a method of recovering heat from the compressed gas. In a vapor recovery step of the dry cleaning process, as described below, heat from the gaseous $CO_2$ is transferred to a heat sink, which may be in the form of heat exchanger immersed in a water bath, before cooling the $CO_2$ by a refrigeration system. This reduces the amount of energy consumed by the refrigeration system. The heat energy stored in the heat sink may subsequently be used to heat cold gas during a cleaning chamber warm-up step of the dry cleaning process, as described below, obviating or reducing the need for additional heating. Thus, the present invention utilizes a heat recovery cycle which improves the cost-efficiency of the dry cleaning process.

Except for specific aspects of the present invention, as described herein, the process and system of the present invention are compatible with existing dry cleaning processes and systems and may be used in conjunction with any cleaning chambers and/or baskets and/or other parts of dry cleaning systems that are known in the art.

A dry-cleaning system in accordance with an embodiment of the present invention includes a storage tank for storing $CO_2$ at a selectable pressure, a cleaning chamber having a pressure containment sufficient to keep $CO_2$ in a liquid state, means for providing a pressure differential between the storage tank and cleaning chamber, a rotatable basket within the cleaning chamber, and a rotational drive mechanism coupled to the basket. In some embodiments of the invention, the system may further include a vapor heat exchanger/recovery system, a refrigeration system, a lint trap/filtration system, and a cleaning chamber ventilation system. The pressure differential between the storage tank and cleaning chamber may be produced by a gas compressor, which may be an oil-less compressor.

A dry cleaning process in accordance with an embodiment of the present invention may include at least some of the following steps:

(a) Removing moisture-laden air from the cleaning vessel. The compressor may act as a vacuum pump to evacuate the air to the atmosphere.

(b) Equalizing pressure between the storage tank and the cleaning chamber in a controlled fashion to avoid clothes damage. $CO_2$ gas may flow from the comparatively higher pressure storage tanks to the comparatively lower pressure cleaning chamber until a predetermined pressure difference exists between the cleaning chamber and the storage tank.

(c) Filling the cleaning chamber with a predetermined amount of liquid $CO_2$ from the storage tank. $CO_2$ vapor may be drawn from the top of the cleaning chamber by the compressor and moved into the top of the storage tank, creating a pressure differential forcing liquid to flow from the bottom of the tank into the cleaning vessel.

(d) Agitating the articles being cleaned by rotating the basket.

(e) Draining used/contaminated liquid from the cleaning chamber. $CO_2$ vapor may be drawn from the top of the storage tank by the compressor and moved into the top of the cleaning chamber, creating a pressure differential forcing liquid from the bottom of the chamber into the bottom of the storage tank. The liquid may pass through a filter system located between the vessels.

(f) Recovering $CO_2$ vapor remaining in the cleaning chamber after drainage. $CO_2$ vapor may be drawn from the top of the cleaning chamber and pushed by the compressor, through a heat recovery system and/or refrigeration system that cools and condenses the vapor into liquid and into the storage tank.

(g) Heating the cleaning chamber. $CO_2$ vapor may be drawn from the top of the cleaning chamber and pushed by the compressor through a heat exchanger system that heats the vapor and into the bottom of the cleaning chamber.

(h) Venting the cleaning chamber. $CO_2$ vapor may flow out of the cleaning chamber through a cleaning chamber ventilation system, which may include a sound control muffler.

BRIEF DESCRIPTION OF THE DRAWINGS

The present invention will be understood and appreciated more fully from the following detailed description of a preferred embodiment of the invention, taken in conjunction with the accompanying drawings of which.

DETAILED DESCRIPTION OF THE INVENTION

Figure 1:
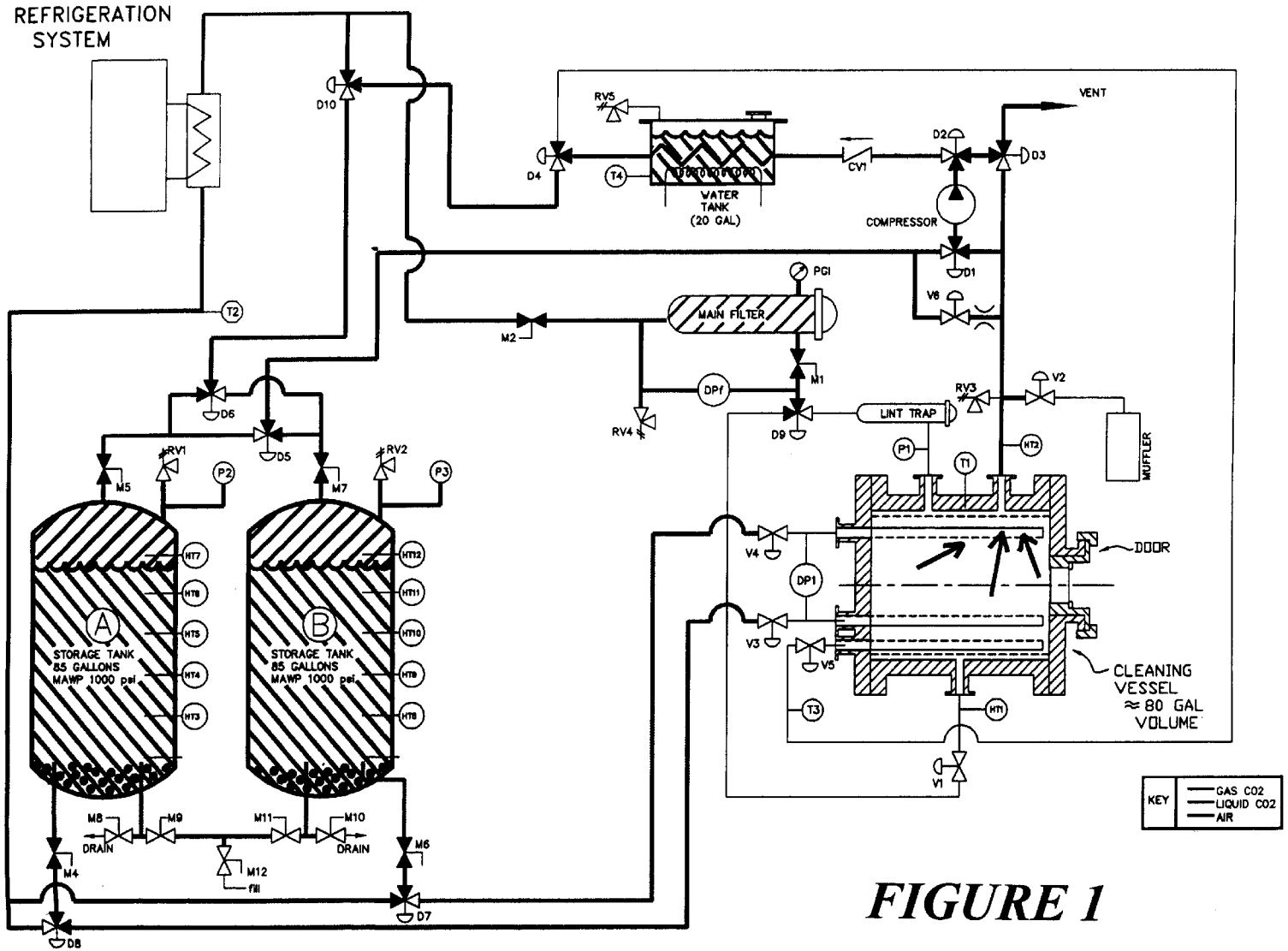
FIG. 1 is a schematic illustration of a dry-cleaning system during an air evacuation step of a dry-cleaning process in accordance with an embodiment of the present invention.

Reference is now made to FIGS. 1–7 which schematically illustrate a dry-cleaning system in accordance with an embodiment of the present invention during various stages of a dry-cleaning process in accordance with an embodiment of the present invention. The system includes a cleaning chamber 10, for example an about 80-gallon cleaning chamber, having a basket 12 for holding articles to be cleaned. Cleaning chamber 10 is preferably designed to have high pressure containment capability, for example, a pressure containment of about 1,100 PSI, sufficient to maintain carbon dioxide ($CO_2$) in a liquid state.

Basket 12 is rotatably mounted within cleaning chamber 10 and is coupled to a basket drive 14 via a coupling 16, which may be of any type suitable for maintaining pressure integrity of cleaning chamber 10, for example, a mechanical coupling with a high-pressure seal, as is known in the art. However, in a preferred embodiment of the invention, coupling 16 is a magnetic coupling which eliminates the need for an opening in chamber 10, as required in the case of mechanical coupling. Rotational driving mechanism using magnetic coupling are well known in the art and are known in the art.

The system further includes at least one storage tank 20 having a predetermined volume capacity, for example, about 30–50 gallons. Storage tank 20 preferably has high pressure containment capability, for example, about 1,100 PSI, and is filled with a predetermined initial amount of $CO_2$, for example, 100 gallons.

In a preferred embodiment of the invention, the system also includes a lint trap/filtration system comprising a lint trap 24, for example, a 100 mesh lint trap, as is known in the art, and a filter 26, for example, a 40 micron filter, as is known in the art.

In accordance with the present invention, the system includes means for providing a pressure differential between storage tank 20 and cleaning chamber 10 that comprises a gas compressor 30, preferably an oil-less compressor. An important advantage of using a gas compressor such as compressor 30, rather than a liquid pump (as used in prior art systems), is that gas flow does not suspend dirt and, thus, dirt is not carried into the compressor. This reduces wear and, consequently, operating and maintenance costs of the dry cleaning system.

Compressor 30 is preferably capable of producing partial vacuum duty and vapor recovery. In an embodiment of the present invention, compressor 30 is capable of decreasing the pressure in cleaning chamber 10 to less than 400 PSI, preferably less than 150 PSI, for example about 50 PSI. It should be appreciated that a low pressure in chamber 10 minimizes wastage of $CO_2$ during venting of the cleaning chamber, as described below. Further, in an embodiment of the present invention, compressor 30 is capable of increasing the pressure in storage tank 20 to more than 750 PSI, preferably more than 850, for example, 900 PSI. It should be appreciated that a high pressure in storage tank 20 maintains the $CO_2$ in liquid state with minimal cooling and, therefore, enables more energy-efficient dry cleaning. The magnitude of the pressure differential produced between storage tank 20 and cleaning chamber 10 may be controlled by varying the motor speed of compressor 30 or using a throttle valve, as is known in the art. An example of an oil-less compressor that may be used in conjunction with the present invention to provide the above described parameters is the Blackmer HDL 322 oil-less compressor, available from Blackmer, Inc., Oklahoma City, Okla.

The system preferably further includes a heat exchanger/recovery system 31 comprising a heat sink/water bath 28 and associated heat exchanger 32 in the embodiment shown. Heat recovery system 31 collects heat energy from hot gas in one step of the dry cleaning process and utilizes that heat energy to warm cold gas during another step, as is described below. Heat energy may be transferred to water bath 28 from $CO_2$ passing through heat exchanger 32 at certain times during the dry cleaning cycle, and water bath 28 may transfer heat to $CO_2$ at other times during the cycle. Preferably, an electric heater 40 is installed in water bath 28 to maintain it at a predetermined temperature, for example, 80° C., during idle periods of the dry-cleaning process.

In an embodiment of the present invention, a refrigeration system 35 with a heat exchanger 36 adapted for cooling $CO_2$ is included. Preferably, refrigeration system 35 possesses sufficient cooling capacity to condense $CO_2$ passing through heat exchanger 36.

As clearly shown in the drawings but not individually referenced, the dry cleaning system includes piping as necessary for connecting between the different system elements of the system and various valves for controlling the operation of the system and $CO_2$ flow during different steps of the dry cleaning process. Some of these valves are specifically discussed below with reference to steps of the dry cleaning method of the present invention. However, the function of most of these valves will be apparent to persons of ordinary skill in the art of dry-cleaning systems. The system further includes a cleaning chamber ventilation system 41 with, preferably, a sound control muffler 46 that may be used during final venting of cleaning chamber 10, as described below.

Figure 7:
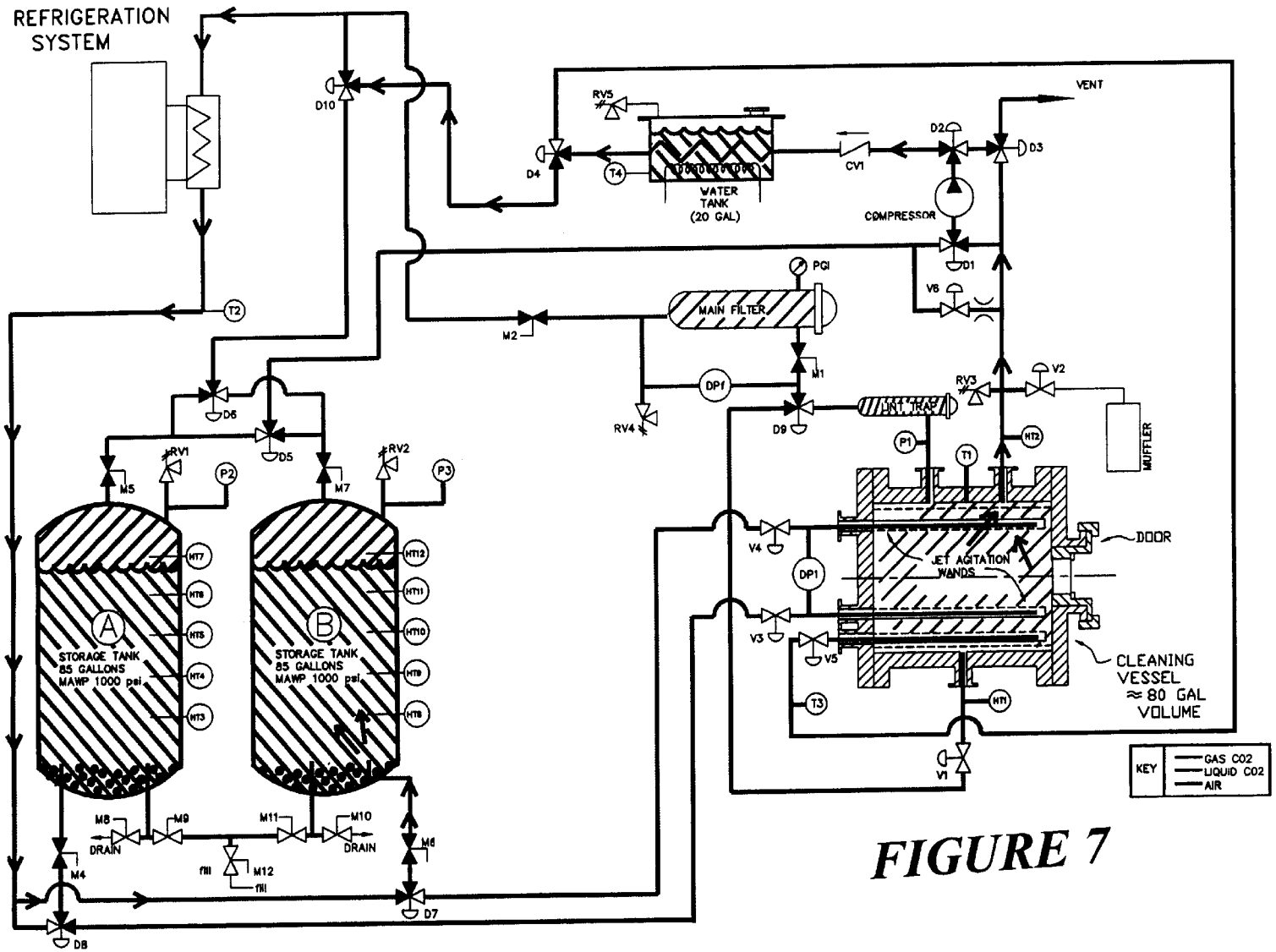
FIG. 7 is a schematic illustration of the system of FIG. 1 during a cleaning chamber ventilation step of a dry-cleaning process in accordance with an embodiment of the present invention.
Figure 8:
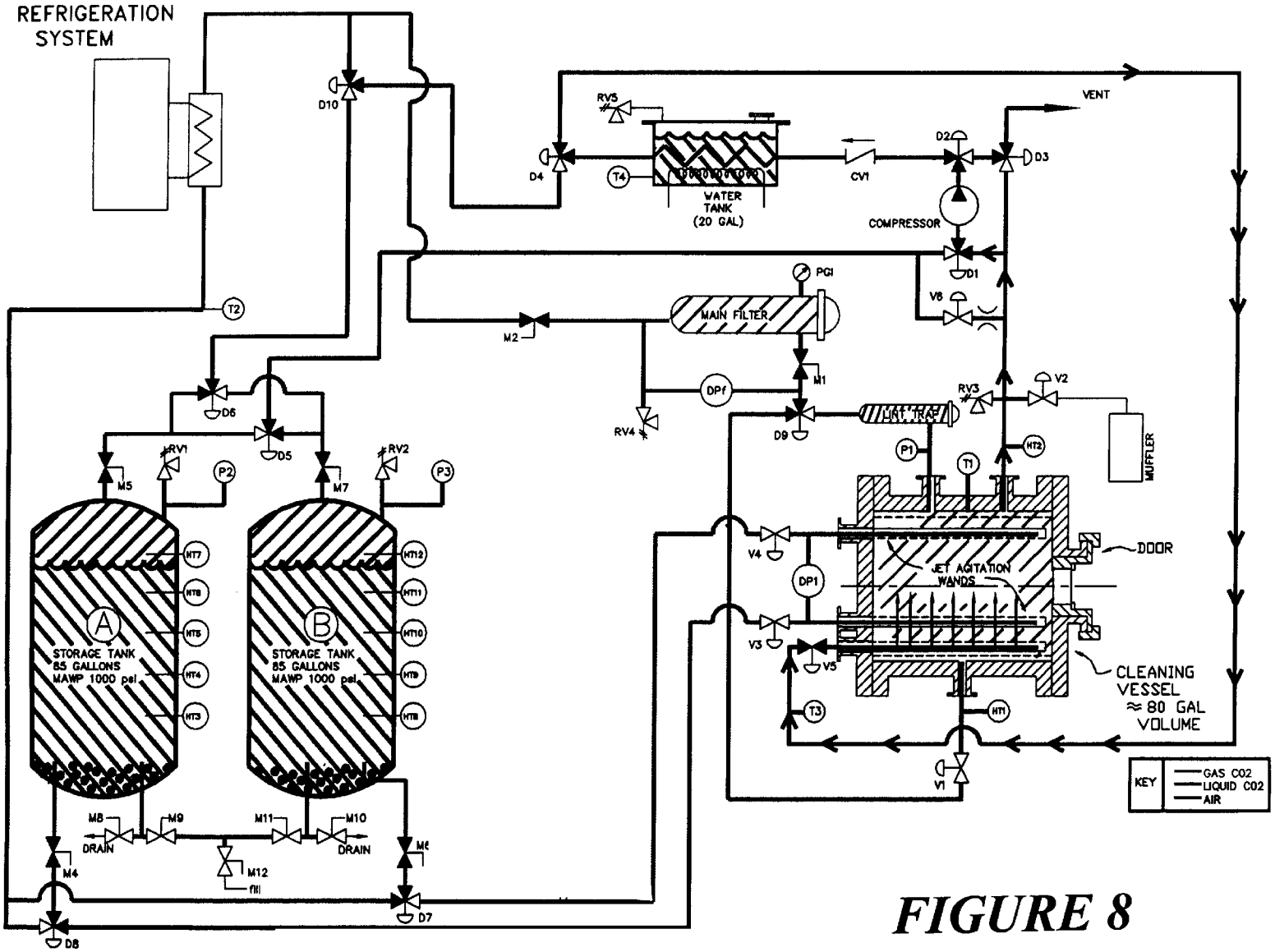
FIG. 8 is a schematic graphic representation of a dry cleaning process sequence in accordance with an embodiment of the present invention.

Reference is now made also to FIG. 8 that schematically illustrates the different steps of a dry cleaning process according to an embodiment of the present invention and shows an exemplary duration for each step. FIG. 8 is self-explanatory to a person skilled in the art. A detailed description of the different steps of the dry cleaning according to an embodiment of the present invention is provided below with reference to FIGS. 1–7.

FIG. 1 illustrates an air evacuation step of the dry-cleaning process in accordance with an embodiment of the present invention. The purpose of this step is to remove moisture laden air, thus reducing the amount of water that dissolves in the $CO_2$. Compressor 30 acts as a vacuum pump with respect to cleaning chamber 10. Compressor 30 is activated for a predetermined time period, for example, about 2 minutes, until a predetermined pressure is reached, for example, 20–25 inches Hg, as determined by a pressure transducer 42. Once the desired pressure level is reached, compressor 30 is shut down.

Figure 2:
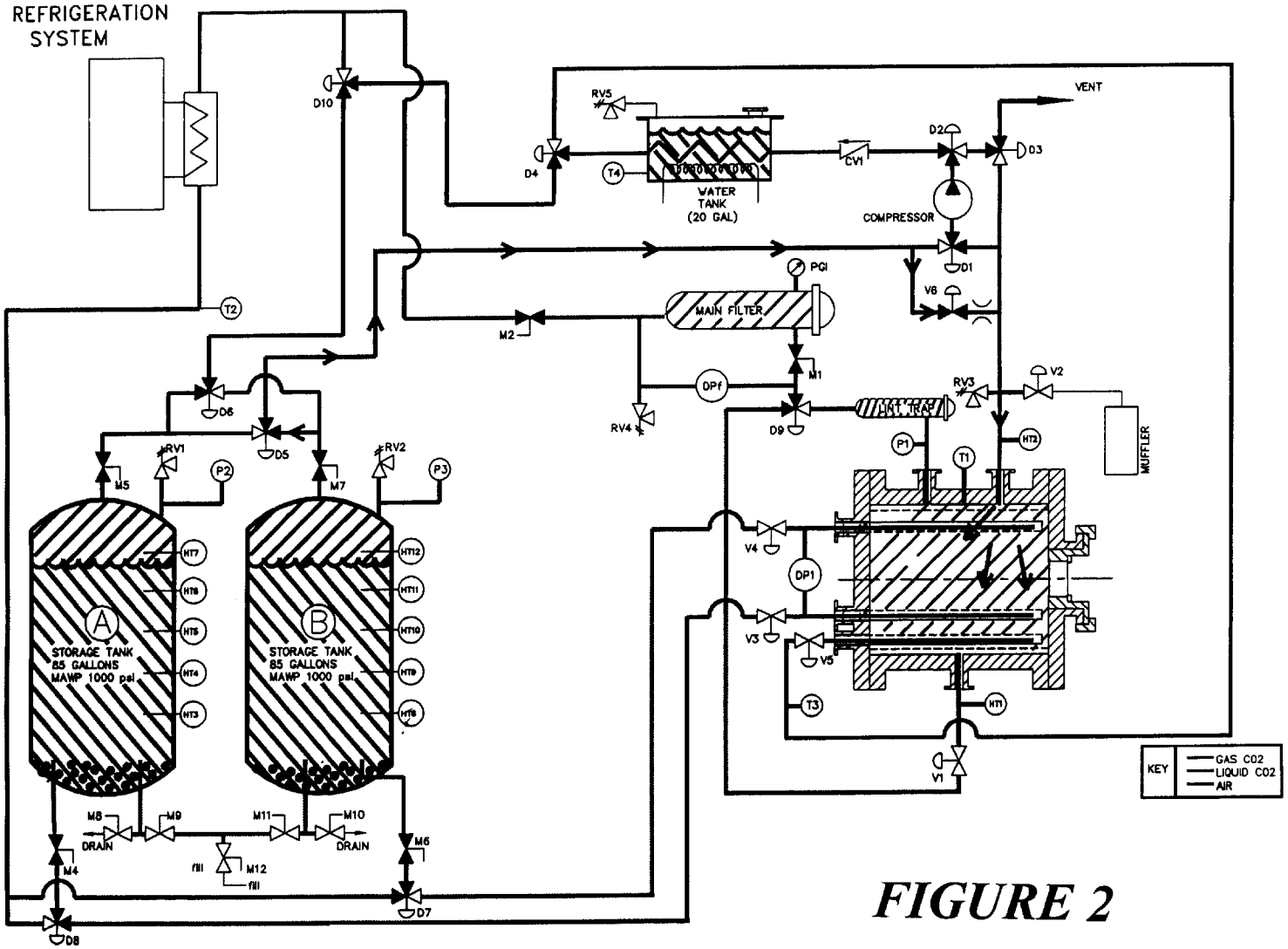
FIG. 2 is a schematic illustration of the system of FIG. 1 during a pressure equalization step of a dry-cleaning process in accordance with an embodiment of the present invention.

FIG. 2 schematically illustrates a pressure equalization step of the dry-cleaning process in accordance with an embodiment of the present invention. During this step, the pressure between storage tank 20 and cleaning chamber 10 is generally equalized in a controlled fashion to avoid damage to the articles being cleaned. Gaseous $CO_2$ flows from the top of storage tank 20 to the top of cleaning chamber 10 through a valve 44 and an orifice 47 until the difference between the readings of pressure transducer 42 and a pressure transducer 48 in the storage tank 10 is below a predetermined threshold, for example a 10 percent pressure differential.

Figure 3:
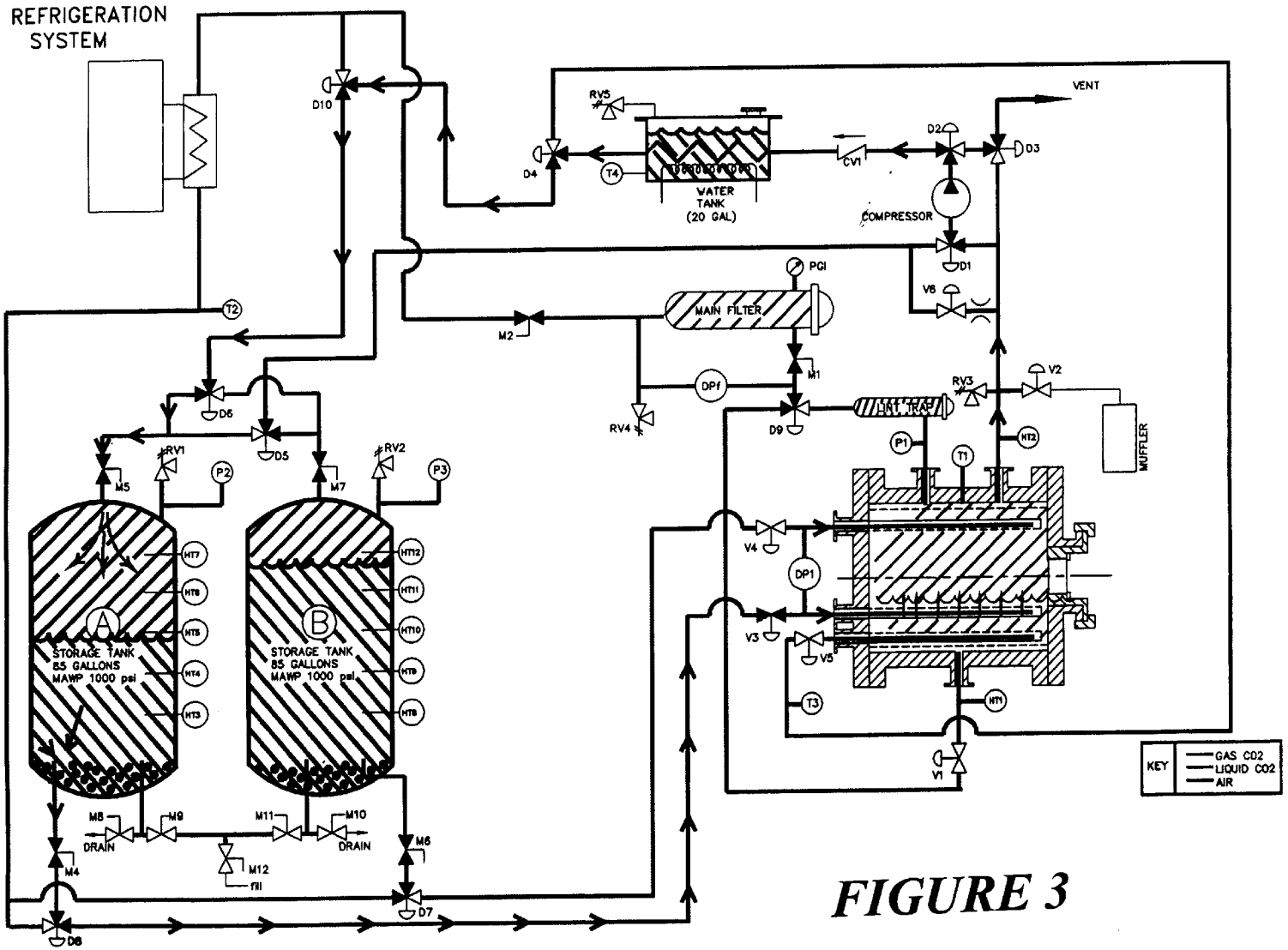
FIG. 3 is a schematic illustration of the system of FIG. 1 during cleaning chamber filling and agitation steps of a dry-cleaning process in accordance with an embodiment of the present invention.

FIG. 3 schematically illustrates a step of partially filling cleaning chamber 10 with liquid $CO_2$ from storage tank 20. Gaseous $CO_2$ is drawn from a top opening 18 of cleaning chamber 10 and is pushed by compressor 30 into the top of storage tank 20. In this step, compressor 30 produces a positive pressure differential between storage tank 20 and cleaning chamber 10, enabling the flow of liquid $CO_2$ from the storage tank to the cleaning chamber. Although heating of the $CO_2$ is not required at this stage of the process, the $CO_2$ flows through heat exchanger 32 in water bath 28, thus utilizing the same piping scheme for different stages of the process. The flow of gas into storage tank 20 forces liquid $CO_2$ out of the bottom and into a bottom opening 38 of cleaning chamber 10 until the desired level of liquid $CO_2$ is reached. This level may be determined by a timer (not shown) and/or by a level sensor 50 associated with storage tank 20.

Also referring to FIG. 3, after filling cleaning chamber 10, the articles within basket 12 may be agitated by rotating the basket. As discussed above, any suitable rotational basket drive 14 may be used. If coupling 16 between basket drive 14 and basket 12 is a mechanical coupling, pressure integrity of cleaning chamber 10 may be maintained by a suitable high pressure seal. In the preferred embodiment, coupling 16 is magnetic so that pressure integrity is not an issue. The basket is agitated for an adequate time to clean the articles located therein, e.g., clothes. The time of the agitation may be dependent upon various factors, including the nature and amount of articles in the cleaning chamber, the composition, temperature and pressure of the solvent, the speed of rotation of basket during agitation, and the configuration of any structures within the basket, e.g., the height of paddles, as is known in the art.

Figure 4:
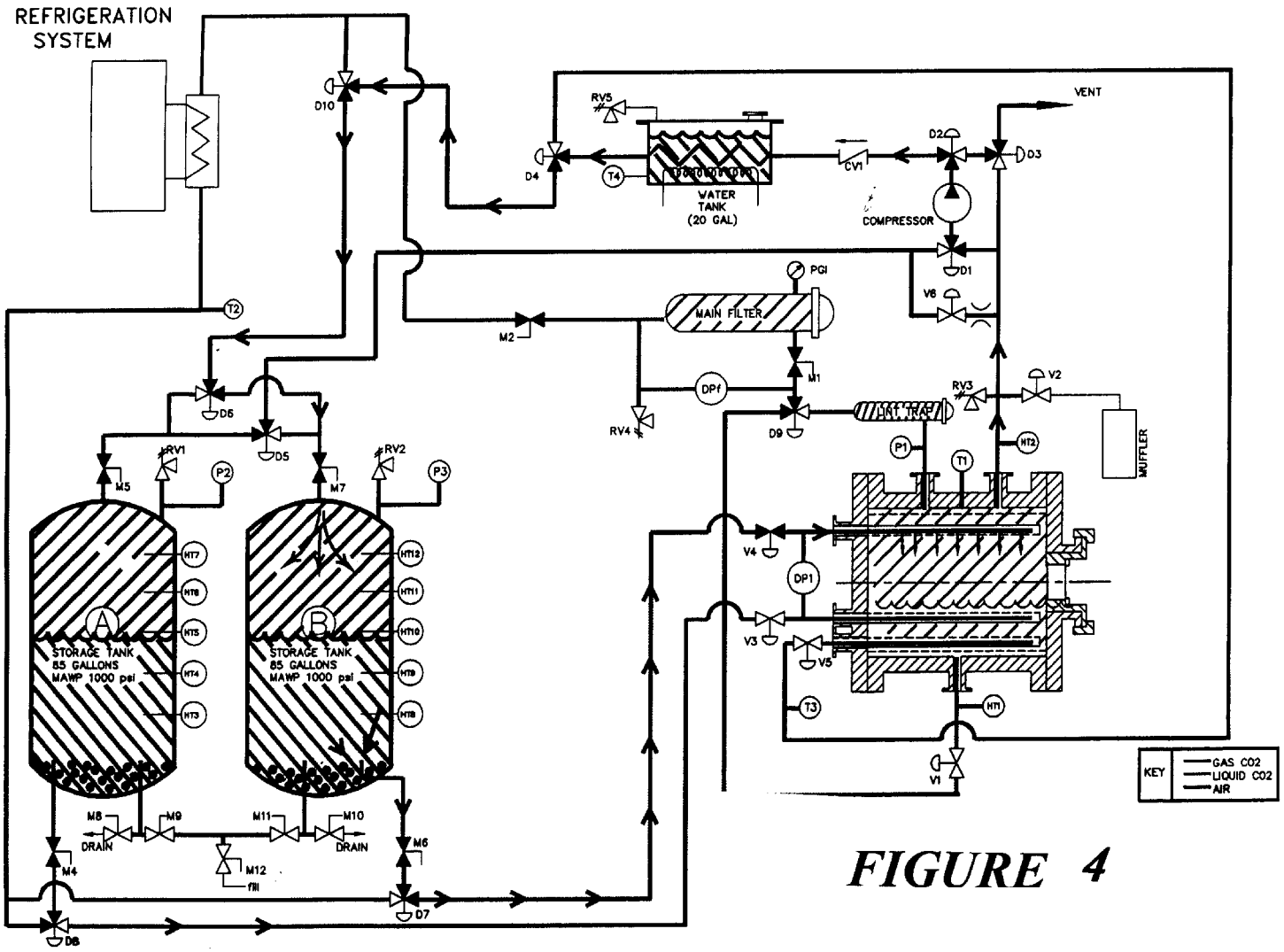
FIG. 4 is a schematic illustration of the system of FIG. 1 during a cleaning chamber draining step of a dry-cleaning process in accordance with an embodiment of the present invention.

Referring to FIG. 4, after agitation as described above, used/contaminated liquid is removed from cleaning chamber 10. Gaseous $CO_2$ is drawn from the top of storage tank 20 and is pumped by compressor 30 into the top opening 18 of cleaning chamber 10. This forces the used/contaminated liquid $CO_2$ out of bottom opening 38 of cleaning chamber 10 and into the bottom of storage tank 20. Thus, in this step, compressor 30 produces a negative pressure differential between storage tank 20 and cleaning chamber 10, enabling the flow of liquid $CO_2$ from the cleaning chamber to the storage tank. Preferably, the liquid flows through lint trap 24 and filter 26 before entering storage tank 10. Also, the liquid preferably passes through refrigeration system 35 via its heat exchanger 36, where it is cooled before entering storage tank 10. The flow stops when a level sensor 57 on cleaning chamber 10 indicates it is empty.

Figure 5:
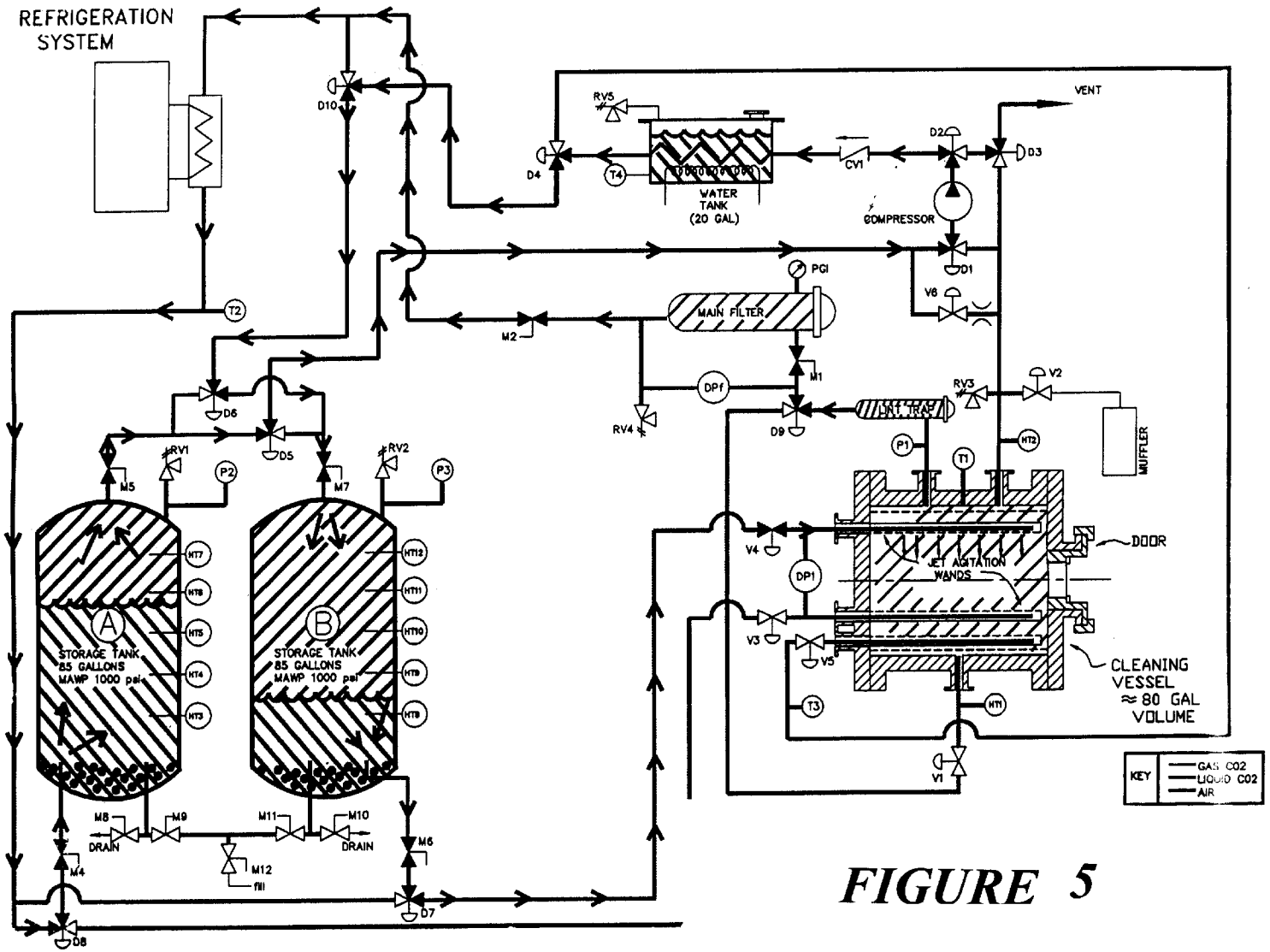
FIG. 5 is a schematic illustration of the system of FIG. 1 during a cleaning chamber vapor recovery step of a dry-cleaning process in accordance with an embodiment of the present invention.

FIG. 5 schematically illustrates a vapor pressure recovery step in accordance with an embodiment of the dry-cleaning process of the present invention. This step recovers $CO_2$ vapor remaining in cleaning chamber 10 after the drainage step described above. Gaseous $CO_2$ is drawn by compressor from top opening 18 of cleaning chamber 10. The gas exiting compressor 30 is hot and needs to be cooled. The gas is directed first through heat exchanger 32 in water bath 28, where some of the heat energy is transferred to water bath 28 and the $CO_2$ is somewhat cooled, and then into heat exchanger 36 in refrigeration system 35. This cools and condenses the $CO_2$ gas back into a liquid state. The liquid $CO_2$ then flows into storage tank 20. The flow stops when the pressure measured by pressure transducer 42 in cleaning chamber 10 reaches a sufficiently low threshold, for example, 50 psi.

Figure 6:
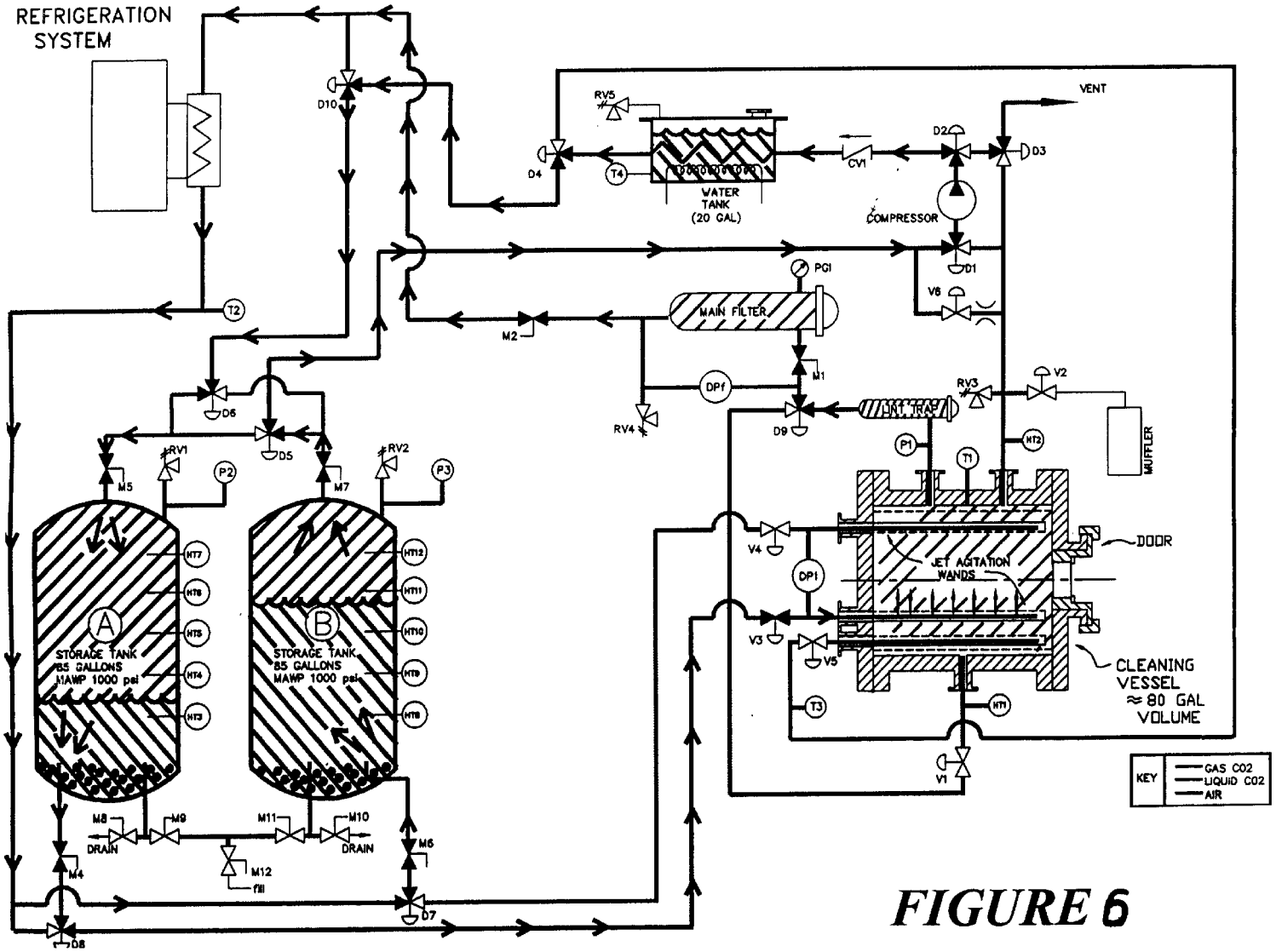
FIG. 6 is a schematic illustration of the system of FIG. 1 during a cleaning chamber warm-up step of a dry-cleaning process in accordance with an embodiment of the present invention.

FIG. 6 schematically illustrates a cleaning chamber warm-up step of the dry-cleaning process in accordance with an embodiment of the present invention. This step is implemented to warm up the interior of cleaning chamber 10 and the articles therein, thereby preventing water ice formation during vapor recovery. Cool $CO_2$ vapor is drawn from top opening 18 of cleaning chamber 10 and is pumped by compressor 30 through heat exchanger 32 in water bath 28, where the $CO_2$ is heated at least in part by transfer of energy that was stored in water bath 28 during the vapor recovery step. The gas then flows through an opening 58 into the cleaning chamber 10. The heated $CO_2$ warms-up cleaning chamber 10 and the articles therein. Heating element 40 may be utilized during this step to transfer heat to water bath 28.

In an embodiment of the present invention, the cleaning chamber warm-up is utilized during vapor recovery. Recovery as described above continues until a first predetermined temperature is reached, for example, 35–40° F., as measured by a temperature sensor 55 in cleaning vessel 10. At this point, vapor recovery pauses and warm-up begins and continues until a second predetermined temperature is reached, for example, a temperature greater than 50° F., which may also be measured by sensor 55. Thereafter, vapor recovery is resumed. For example, the dry-cleaning process summarized in FIG. 10 includes two vapor recovery steps, 3 minutes and 5 minutes, respectively, with an interceding two minute warm-up step.

FIG. 7 schematically illustrates a cleaning chamber venting step of the dry-cleaning process in accordance with an embodiment of the present invention. Remaining $CO_2$ vapor within cleaning chamber 10, which may be at about 50 psi, is vented through cleaning chamber ventilation system 41. When the pressure, measured by pressure transducer 42 in cleaning chamber 10 reaches a sufficiently low threshold, door 60 of cleaning chamber 10 may be safely opened and the clean articles removed. In an embodiment of the present invention, the $CO_2$ vapor may be released either to the system surroundings or outdoors via a venting pipe (not shown). Sound control muffler 46 and/or a throttling device (not shown) may also be utilized to control the venting rate.

While the embodiment of the invention shown and described herein is fully capable of achieving the results desired, it is to be understood that this embodiment has been shown and described for purposes of illustration only and not for purposes of limitation. Other variations in the form and details that occur to those skilled in the art and that are within the spirit and scope of the invention are not specifically addressed. Therefore, the invention is limited only by the appended claims.

What is claimed is:

1. Dry-cleaning apparatus for cleaning articles comprising:

a storage tank for storing carbon dioxide ($CO_2$);

a cleaning chamber having a rotatable member therein;

a rotation mechanism for rotating the rotatable member;

a compressor for establishing a pressure differential between the storage tank and the cleaning chamber sufficient to transport liquid $CO_2$ between the storage tank and the cleaning chamber; and a heat sink in thermal communication with a $CO_2$ vapor flow between the storage tank and the cleaning chamber and operative to collect heat from relatively warm $CO_2$ vapor and to transfer heat to relatively cold $CO_2$ vapor, whereby part of the heat collected from the relatively warm $CO_2$ vapor is transferred to the relatively cold $CO_2$ vapor.

2. Apparatus according to claim 1 wherein the compressor is capable of raising the pressure in the storage tank to at least 750 PSI.

3. Apparatus according to claim 2 wherein the compressor is capable of raising the pressure in the storage tank to about 900 PSI.

4. Apparatus according to claim 1 wherein the compressor is capable of lowering the pressure in the cleaning chamber to less than 150 PSI.

5. Apparatus according to claim 4 wherein the compressor is capable of lowering the pressure in the cleaning chamber to about 50 PSI.

6. Apparatus according to claim 1 wherein the compressor comprises an oil-less compressor.

7. Apparatus according to claim 1 wherein the rotation mechanism comprises a rotation drive and a coupling between the rotation drive and the rotatable member.

8. Apparatus according to claim 7 wherein said coupling comprises a magnetic coupling.

* * * * *